US005925844A

United States Patent [19]

Inaba

[11] Patent Number: 5,925,844

[45] Date of Patent: Jul. 20, 1999

[54] PIANO WITH BUILT-IN ELECTRONIC MUSICAL INSTRUMENT

[75] Inventor: Tatsuya Inaba, Hamamatsu, Japan

[73] Assignee: Kabushiki Kaisha Kawai Gakki Seisakusho, Sizuoka, Japan

[21] Appl. No.: 08/894,543

[22] PCT Filed: Mar. 29, 1995

[86] PCT No.: PCT/JP96/00606

§ 371 Date: Aug. 20, 1997

§ 102(e) Date: Aug. 20, 1997

[87] PCT Pub. No.: WO96/30891

PCT Pub. Date: Oct. 3, 1996

[51] Int. Cl.[6] ..... G10C 5/00; G10F 1/22; G10H 1/46

[52] U.S. Cl. ..... 84/633; 84/2; 84/3; 84/21; 84/171

[58] Field of Search ..... 84/2, 3, 19–23, 84/170–172, 719, 720, 744, 745, DIG. 7, 615–620, 626–633

[56] References Cited

U.S. PATENT DOCUMENTS 4,704,931 11/1987 Nagai et al. ..... 84/2 X
5,530,198 6/1996 Ishii ..... 84/21
5,552,559 9/1996 Sugiyama ..... 84/171

FOREIGN PATENT DOCUMENTS 62-157093 7/1987 Japan .
63-216099 9/1988 Japan .
5-265446 10/1993 Japan .
6-59667 4/1994 Japan .
5-214411 10/1995 Japan .

*Primary Examiner*—Stanley J. Witkowski
*Attorney, Agent, or Firm*—Davis and Bujold

[57] ABSTRACT

The invention was developed in order to play an electronic piano in the same manner as when playing an acoustic piano without feeling any sense of incompatibility. At S100, the key velocity (key stroke strength) is detected by key sensors 33 and 35. At S110, the detected key stroke strength is converted referring to the conversion table stored in ROM 43 and showing a touch curve. At S120, based on said converted key stroke strength data, an electronic sound source 9 and an amplifier 11 are controlled to generate sounds from speakers. The converted key stroke strength represents the sound volume. Since the conversion table of the present embodiment is set so that when the electronic piano is played with the same touch as in playing the acoustic piano, the same sound volume as the acoustic piano can be obtained. Therefore, the player do not feel any sense of incompatibility.

6 Claims, 6 Drawing Sheets

PIANO WITH BUILT-IN ELECTRONIC MUSICAL INSTRUMENT

TECHNICAL FIELD

This invention relates to a piano with built-in electronic musical instrument comprising a conventional system for playing by striking strings and further a system for playing by controlling an electronic sound source.

BACKGROUND OF THE INVENTION

In a conventional electronic piano or other for playing in response to key depressions on the keyboard, an electronic sound source is controlled in accordance with the key stroke conditions, thereby generating sounds for playing. Such electronic piano is provided with a sensor below the key or at other positions for detecting the key stroke conditions. The sensor detects the touch information (touch data) including the key velocity (the key stroke strength). In addition, for modifying the sound generating level in accordance with the key stroke strength, the sensibility (the effectiveness) of the key touch is controlled for each key on the keyboard.

The effectiveness of the key touch defines the relationship between the key touch strength data and the output signal level (the sound level) which is transferred to the sound source. For example, as shown in FIG. 6, by applying an inclined line (touch curve) for modifying the data, a touch data before conversion (on the horizontal axis) is modified into a touch data after conversion (on the longitudinal axis). Based on the touch data after conversion, the output sound level is controlled.

For setting the effectiveness of the key touch, a map corresponding to the touch curve is stored in ROM or other in advance.

However, in a so-called piano with built-in electronic musical instrument, which is a combination of an acoustic piano and an electronic sound source so that it can be played using the electronic sound source in addition to usual piano playing, if a touch curve of conventional electronic piano is applied, the intensity of electronic sounds differ from that of natural piano sounds, which is a problem.

Since the keyboard of a piano with built-in electronic musical instrument is the same as that of an acoustic piano, the force transferred from the keyboard to the finger by an action system or other is of course largely different from that of a conventional electronic piano. Specifically, the action system of the piano has various characteristics for each key. Therefore, when it is played using the electronic sound source in the same manner as when played as an acoustic piano, the actual sounds generated from the electronic sound source (the electronic sounds) are significantly different from the sounds the player wishes to generate (the natural piano sounds). Further, the more the player gets used to the key touch of the acoustic piano, the more sense of incompatibility is felt in playing using the electronic sound source.

SUMMARY OF THE INVENTION

Wherefore, the object of the present invention is to provide a piano with built-in electronic musical instrument in which the player can play without feeling any sense of incompatibility using the electronic sound source, similarly as in playing as an acoustic piano.

To achieve the aforementioned object, the invention of the present claim 1 provides, as shown in FIG. 1, a piano with built-in electronic musical instrument, which is an acoustic piano with built-in electronic musical instrument having an electronic sound source, and a keyboard is used for both plays, comprising:

an input condition detecting means M2 for detecting the input condition from a key M1 of said keyboard in playing using said electronic musical instrument;

a modification data storing means M3 for storing modification data which are map data or arithmetic expression data for modifying the effectiveness of said key M1; and an input information modifying means M4 for modifying the input information of the key M1 detected by said input condition detecting means M2 based on the modification data stored in said modification data storing means M3, wherein the modification data stored in said modification data storing means M3 are set so that the sound generating condition when the electronic musical instrument is operated coincides with that when the acoustic piano is operated.

The invention of the present claim 2 provides a piano with built-in electronic musical instrument of claim 1, in which said modification data has been modified corresponding to a particular key or groups of keys.

Said modification data can be a touch data for modifying the loudness of sounds in accordance with the key stroke velocity (the key stroke strength).

The particular key or groups of keys can be defined by, for example, dividing the keys on the keyboard into white keys and black keys or into plurality of areas.

In the piano with built-in electronic musical instrument of claim 1 having the aforementioned structure, the input condition of the key M1 on the keyboard is detected by the input condition detecting means M2 as an input information when the electronic musical instrument is played. The input information of the key M1 detected by the input condition detecting means M2 is modified by the input information modifying means M4 stored in the modification data storing means M3, using modification data which are for example map data or arithmetic expression data for modifying the effectiveness of the key M1. Specifically, the modification data stored in the modification data storing means M3 are set so that the sound condition when the electronic musical instrument is operated coincides with that when the acoustic piano is operated. Therefore, when the electronic musical instrument is operated with the same key touch as in playing the usual acoustic piano, which means when the key on the keyboard (for both the electronic musical instrument and the acoustic piano) is depressed, the same sound as in playing an usual acoustic piano is generated without feeling any sense of incompatibility.

According to the invention of the present claim 2, since the modification data are modified corresponding to a particular key or groups of keys for example black keys and white keys, the amount of the modification data to be stored can be small.

DESCRIPTION OF THE PREFERRED EMBODIMENT(S)

Figure 1:
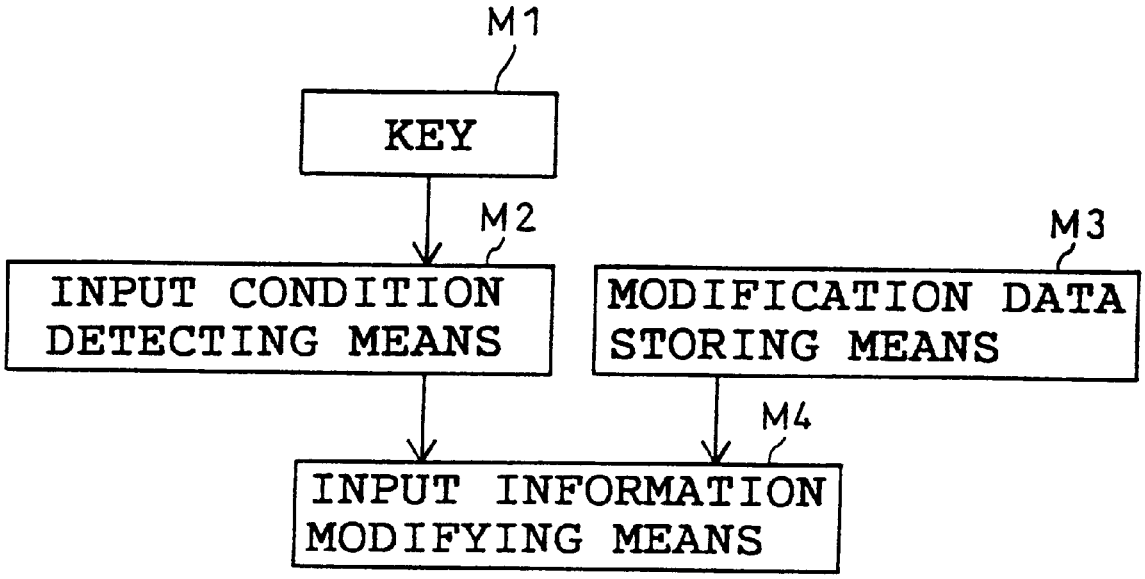
FIG. 1 is a block diagram schematically showing the structure of the present invention.
Figure 2:
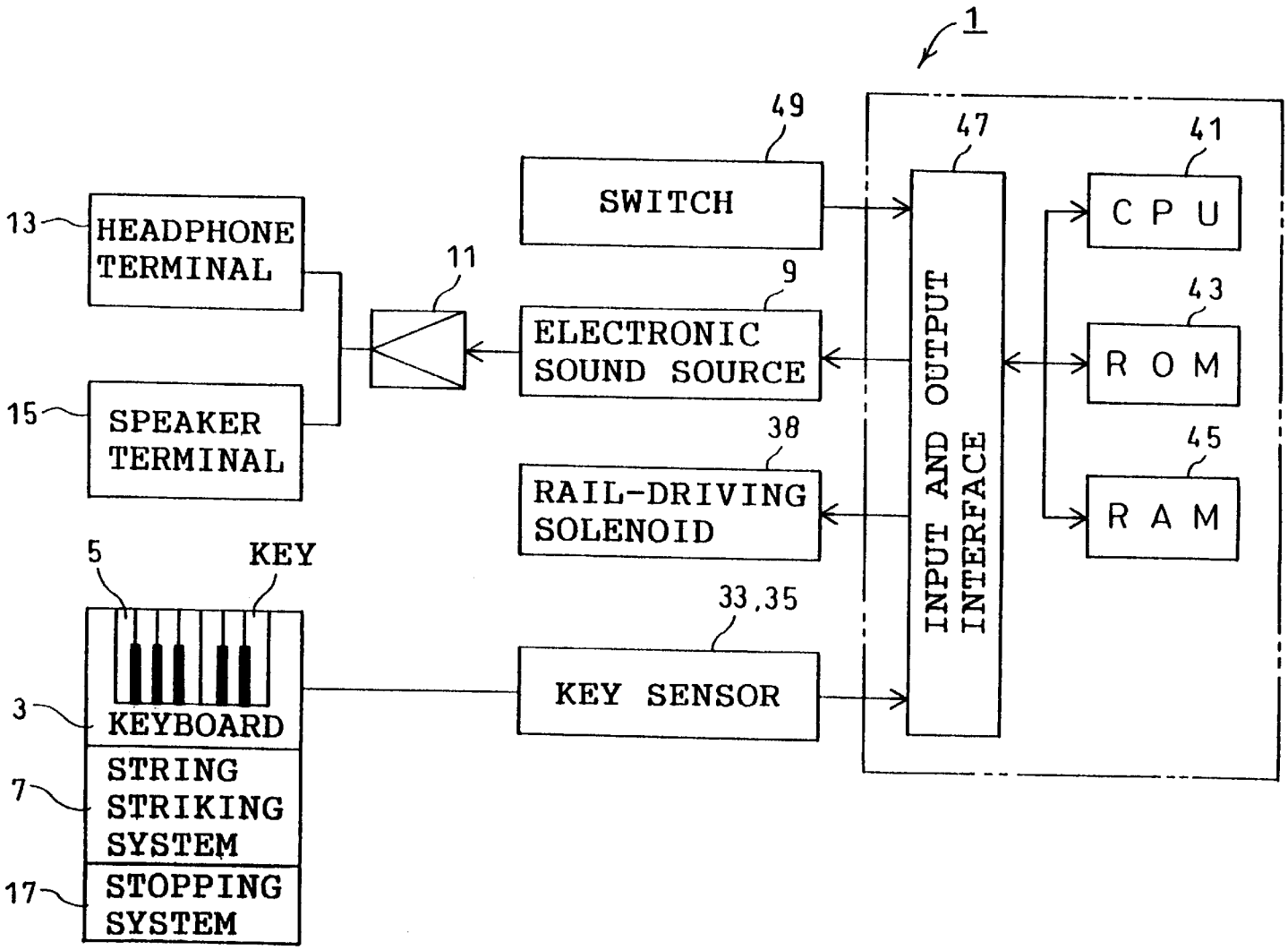
FIG. 2 is a block diagram showing the electrical structure of the upright piano of the embodiment.
Figure 3:
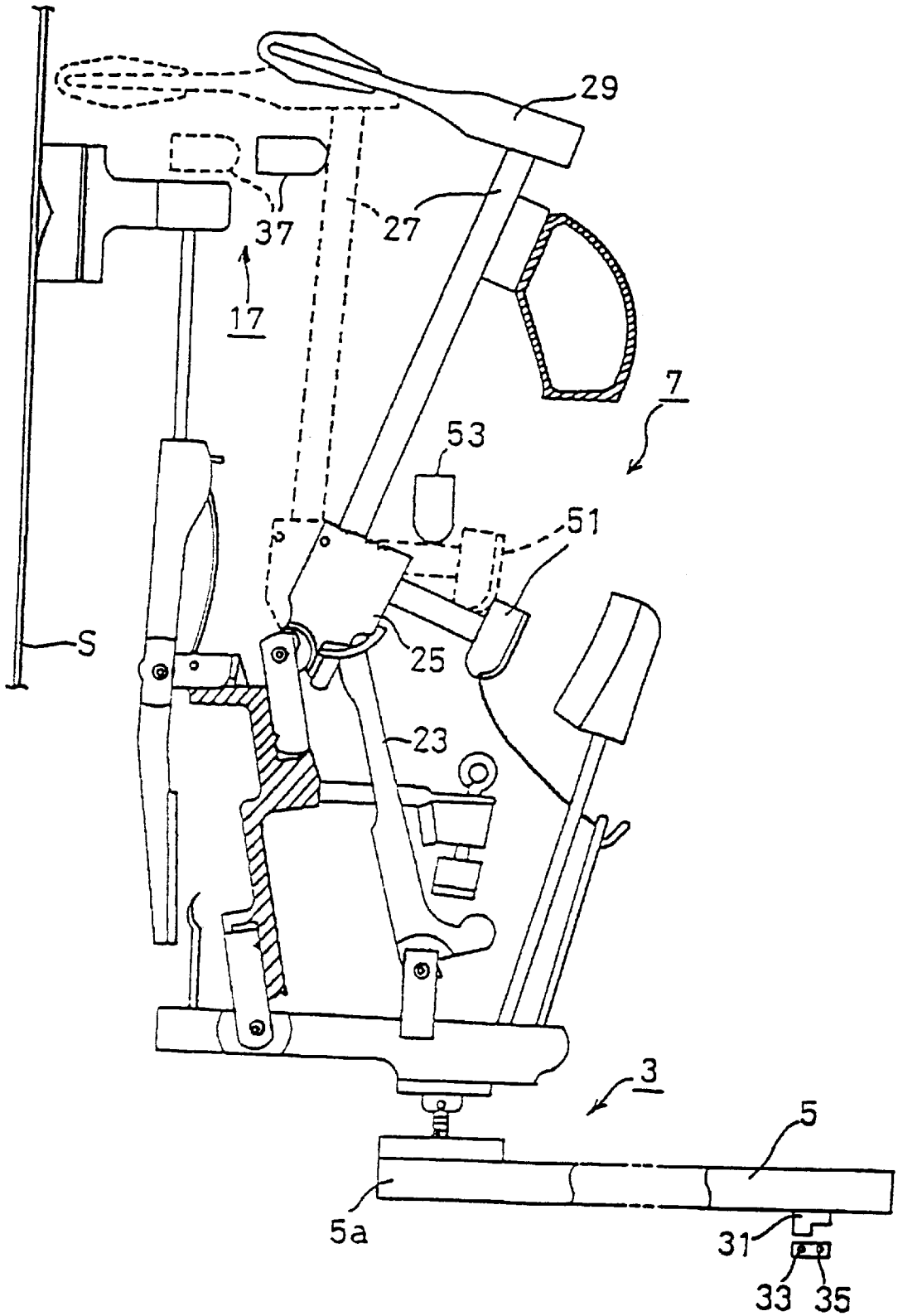
FIG. 3 is a schematic view showing the inner structure of the upright piano of the embodiment.

The embodiment of the invention is now explained referring to the drawing figures. FIG. 2 is a block diagram schematically showing the structure of an upright piano of the embodiment. FIG. 3 is a schematic view showing the string striking system and the stopping system of the upright piano.

As shown in FIG. 2, the upright piano 1 of the present invention comprises a string striking system 7 for striking the strings in response to the operation of keys 5 of a keyboard 3 similarly with a conventional piano so that it can be played as an acoustic piano. The upright piano 1 further comprises an electronic sound source 9 to be controlled in response to the operation of the keyboard 3 so that it can be played as an electronic piano via speakers or a headphone (not shown in the drawing figures).

The upright piano 1 further comprises an amplifier 11 connected to the electronic sound source 9, a headphone terminal 13, a speaker terminal 15, a stopping system 17 for stopping the string striking system 7 from generating sounds when it is played using the electronic sound source 9, and a control component 19 for controlling the electronic sound source 9 in response to the operation of the keyboard 3.

The aforementioned structure is explained hereinafter in detail.

The string striking system 7 performs in the same manner as that of a conventional upright piano, as shown in FIG. 3. Specifically, in the string striking system 7, when a key 5 of the keyboard 3 is depressed by a player, a rear end 5*a* of the key 5 swings up. Then a jack 23 sticks up a butt 25 and a hammer shank 27 pivots toward a string S. As the jack 23 further rises, the butt 25 separates from the jack 23 and the hammer shank 27 starts inertial movement (pivotal movement). As a result, a hammer 29 provided at the leading edge of the hammer shank 27 strikes the string S.

At the reverse side of the front end of the key 5, a stepped shutter 31 and key sensors 33 and 35 are disposed as a means for detecting the depressing and separating action of the key 5. Each of the key sensors 33 and 35 is formed of a combination of a light emitting element and a light receiving element, and is composed to generate an ON signal against any disturbance between these two elements. Specifically, when the key 35 is depressed, there is a certain time interval between interruptions of the optical paths of the key sensors 33 and 35 by the stepped shutter 31. From the time interval, the velocity of the moving key 5 can be calculated. The detailed structure and action of the aforementioned string striking system 7 are disclosed for example in Japanese Patent Application No. H5-214411.

On the other hand, the stopping system 17 comprises, as shown in FIG. 3, a rail 37 disposed between the hammer shank 27 and the string S. The rail 37 is an elongated member which extends to the horizontal direction of the piano 1 (the vertical direction in FIG. 3) and can be moved between the position indicated in the figure by solid lines (movement stopping position) and the position indicated in the figure by dotted lines (movement allowing position) by a rail driving solenoid 38 (FIG. 2) or other means. Therefore, when the stopping system 17 stops the string striking system 7 from generating sounds (when playing using the electronic sound source), the rail 37 is fixed to the movement stopping position, and the inertially pivoting hammer shank 27 abuts the rail 37 at the position indicated by the dotted lines in the figure. Accordingly, the hammer 29 does not strike the string, thereby generating no sound. The detailed structure and action of the aforementioned stopping system 17 are disclosed for example in Japanese Patent Application No. H5-214411.

As shown in FIG. 2, the control component 19 for controlling the electronic sound source 9 is composed as a logical circuit including a CPU 41, a ROM 43, a RAM 45 and others which are known, and is connected, via an input and output interface 47, to the electronic sound source 9, the key sensors 33, 35 and a switch 49 for making a selection between playing using the string striking system 7 and playing using the electronic sound source 9.

When playing using the string striking system 7 has been selected by the switch 49, the control component 19 moves the rail 37 of the stopping system 17 toward the movement allowing position (shown in FIG. 3) and fixes the same thereto. As a result, playing with the string striking sounds becomes possible. At this time the control component 19 does not control the electronic sound source 9. On the other hand, when electronic piano playing using the electronic sound source 9 has been selected by the switch 49, the control component 19 moves the rail 37 of the stopping system 17 toward the movement stopping position and fixes the same thereto. As a result, the control of the electronic sound source 9 by the control component 19 becomes possible.

The control component 19 detects which key 5 has been interrupted its optical path between the key sensors 33 and 35 of the key 5 has been interrupted. At the same time, it detects the moment of the interruption of each optical path of the key sensors 33 and 35 and the time interval between the interruptions of the optical paths, thereby making the touch data show the group the key 5 belongs to and the key velocity (the key stroke strength) based on the control program stored in the ROM 43. Thus, the control component 19 produces playing information in response to the signals from the key sensors 33 and 35, and transferring the information to the electronic sound source 9 for controlling. Said touch data may be, for example, data showing the key number representing the pitch and data showing the key stroke strength representing the sound volume.

Further in the present embodiment, a touch curve for converting the touch data is stored in the ROM 43 as a map (a conversion table) data for converting the key stroke strength data to the speaker volume so that the speaker volume in playing as an electronic piano equals to the actual sound volume of the acoustic piano. Therefore, under the condition that the electronic piano is operated, even if the key 5 is depressed with the same touch as in playing the acoustic piano, it is possible to generate the same sounds as those of the acoustic piano.

The touch curve stored in the ROM 43 is set in advance in the following manner. For example, the determination process of the converting table of the touch curve of the key C4, which is for the middle tone in the 88 keys, is explained.

Figure 4A:
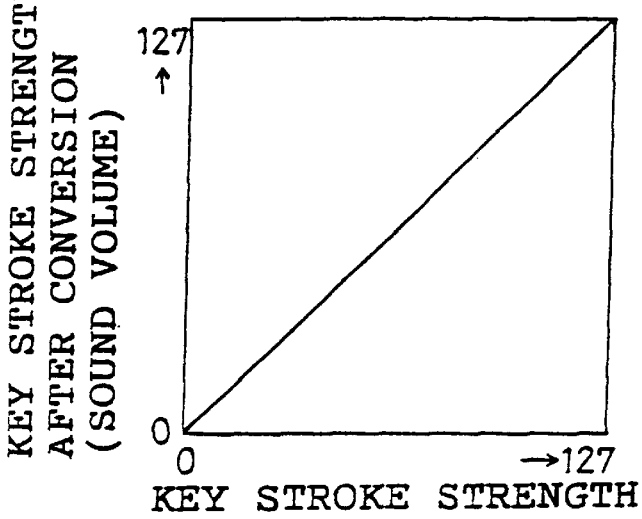
FIGS. 4A–4D are graphs showing the touch curves for modifying the touch data of the embodiment.

(1) First, as shown in FIG. 4A, a straight touch curve showing the relationship between the detected key stroke strength (on the horizontal axis) and the key stroke strength after conversion (on the vertical axis: corresponding to the actual sound volume), is formed between 0 and 127 in the scale.

(2) Next, under the OFF condition of the electronic piano, the acoustic piano is actually played. The sound volume of the piano is recorded using a microphone or other. A touch curve showing the relationship between the detected key stroke strength and the actual sound volume of the acoustic piano as shown in FIG. 4B is formed.

(3) Under the ON condition of the electronic piano, the electronic piano is actually played. The sound volume of the piano from the speaker is recorded using a microphone or other device. A touch curve showing the relationship between the detected key stroke strength and the actual sound volume of the electronic piano as shown in FIG. 4C is formed.

Figure 4B:
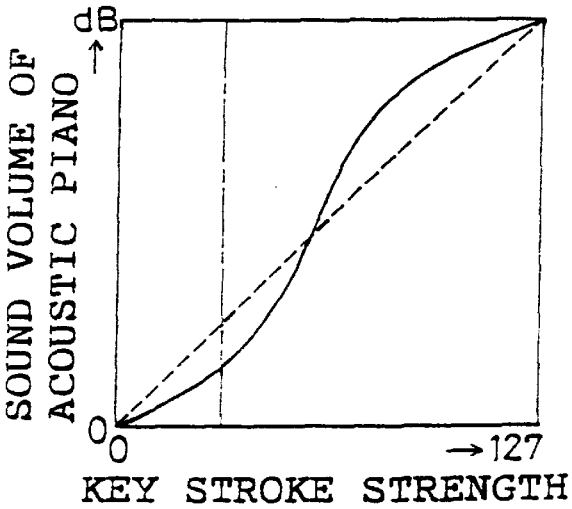
Figure 4C:
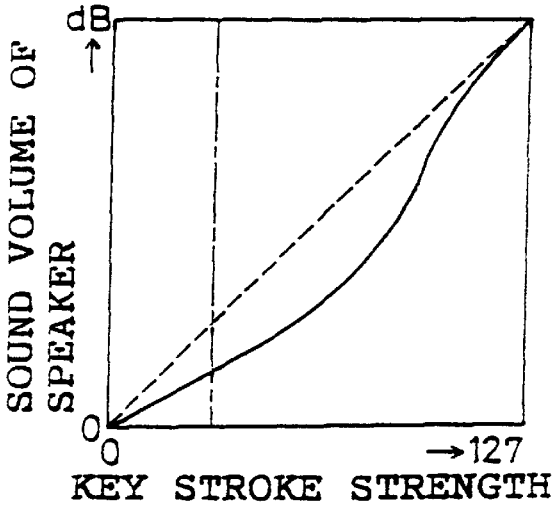
Figure 4D:
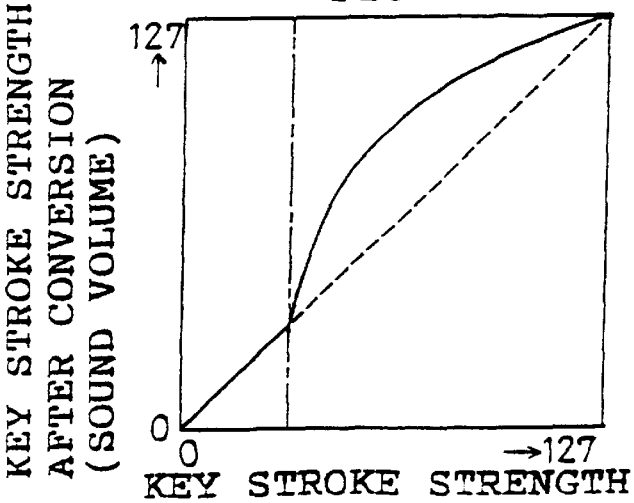

(4) As is obvious from these FIGS. 4B and 4C, the sound volume of the acoustic piano and the electronic piano for the same key stroke strength are largely different from each other. Therefore, in this embodiment, as shown in FIG. 4D, a touch curve is set referring to FIGS. 4B and 4C so that the same sound volume can be achieved for the same key stroke strength whether the piano is set as an acoustic piano or as an electronic piano. The touch curve can be formed, for example, for each key 5 or for white keys and black keys.

Next, the action of the upright piano 1 of the present invention having the aforementioned structure is explained hereinafter referring to FIGS. 3 and 5.

When the upright piano 1 is set as an acoustic piano by the switch 49, the rail 37 is disposed at the movement allowing position as shown in FIG. 3. Therefore, the hammers 29 can strike the strings. Accordingly, a player can play by operating the keyboard 3 to strike the strings, which is the same way as in playing a conventional acoustic piano.

On the other hand, when the upright piano 1 is set as an electronic piano by the switch 49, the rail 37 is disposed at the aforementioned movement stopping position. Therefore, a player cannot play striking strings to generate sounds as in playing a conventional acoustic piano. Instead, the player can play by operating the keyboard 3 to control the electronic sound source 9, from which electronic sounds are generated via speakers.

Figure 5:
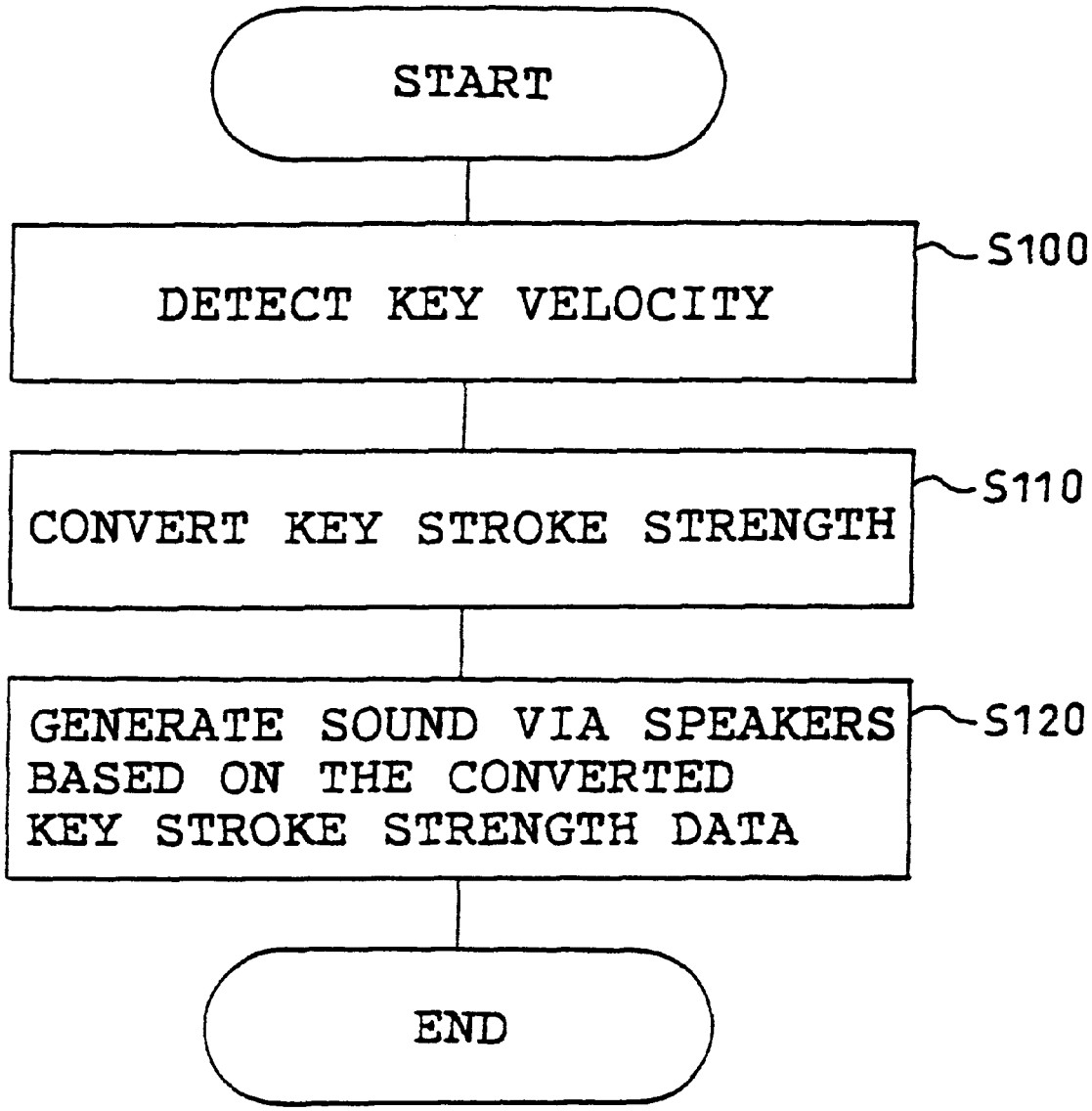
FIG. 5 is a flowchart showing the control process of the embodiment.
Figure 6:
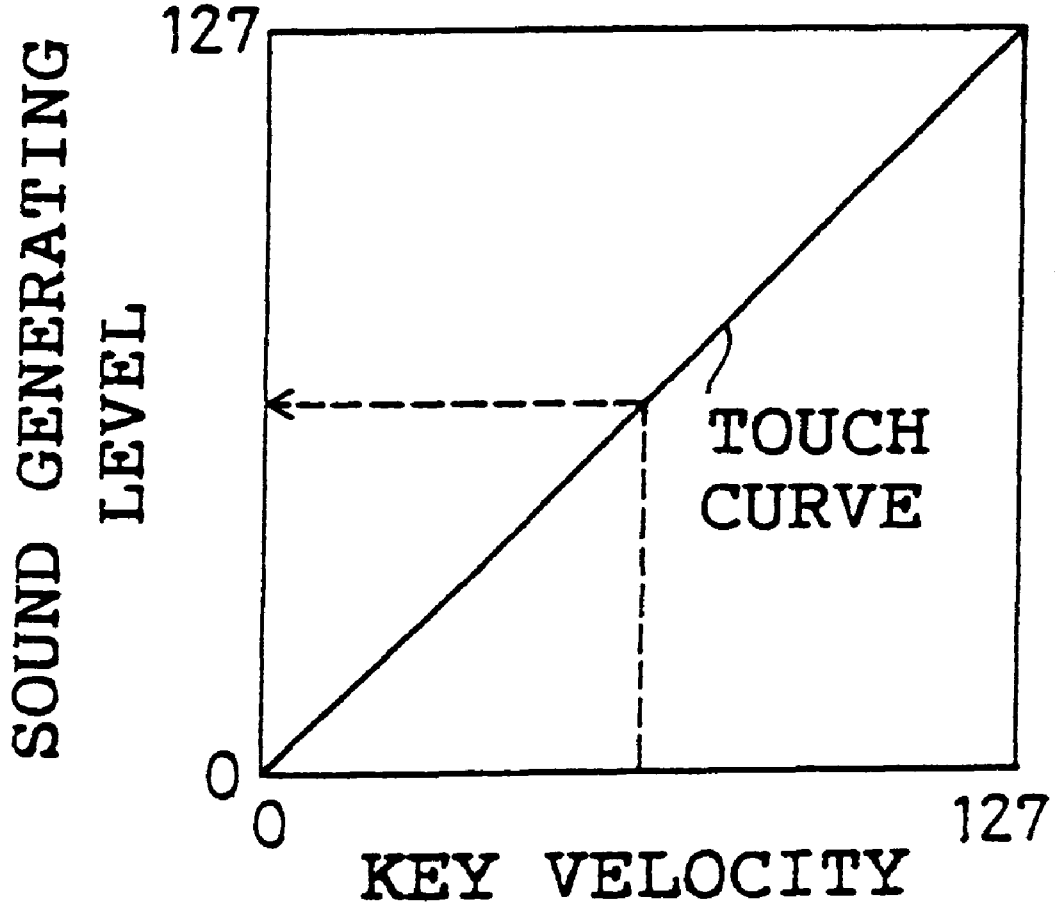
FIG. 6 is a graph showing a conventional art.

In this case, as shown in the flowchart of FIG. 5, first the velocity of a key 5 (the key stroke strength) is detected via the key sensors 33 and 35 at S100. Then the detected key stroke strength is converted referring to a conversion table stored in ROM 43, which is shown as a touch curve of FIG. 4D at S110. At S120, based on the converted key stroke strength data, the electronic sound source 9 and the amplifier 11 are controlled to generate a sound via speakers. The converted key stroke strength shows the sound volume, which represents the intensity of the sound. As aforementioned, the conversion table of this embodiment is set so that when the player plays the electronic piano with the same touch as in playing the acoustic piano, the sound volume equals to that of the acoustic piano. Therefore, the player can play without feeling any sense of incompatibility.

That means, since the upright piano 1 of the embodiment is provided with the aforementioned conversion table, a player can play the electronic piano with the same touch as in playing the acoustic piano, and can achieve the same sound volume as that of the acoustic piano. Accordingly, it is the remarkable effect of the present invention that the player can play or practice while listening to the sounds from a headphone or speakers without feeling any sense of incompatibility, as if playing the acoustic piano.

Since a player can practice with the same touch as in playing the acoustic piano using a headphone or other device at night or under any other conditions, the superior efficiency of practice obtained. Furthermore, in this embodiment, even if the player gets used to the key touch of the acoustic piano, no sense of incompatibility is felt in playing the electronic piano.

The present invention is not limited to the aforementioned embodiments. Alterations and modifications can be made within the scope of the invention.

For example, in the aforementioned embodiment, a conversion table showing a touch curve is used for changing the touch data. However, the touch data may be converted using arithmetic expressions or formulas stored in the ROM.

The keys may be divided into plurality of areas and one conversion table may be provided for each area.

In the embodiment, the speakers are connected to the speaker terminals. However, the speakers may be attached to the piano itself.

In the present embodiment, a touch curve is formed by gathering the sounds generated from the speakers with microphones. However, the sounds may be gathered from the output terminals of the headphone or the speakers, or from other line out terminals.

Furthermore, as a stopping system for stopping the string stroke system from generating sounds, a rail 53 for example may be provided for stopping the movement of the catcher shank 51, as is shown in FIG. 3. The stopping system needs not to stop the inertial movement of the hammer. As is disclosed in the Japanese Patent Laid-Open No. S63-216099, a stopping system (a sound stopping system) may be used, in which a pushing means pivots a hammer rail to push a hammer to a string, and then a locking means keeps the hammer in the pushing condition.

The present invention can be applied to a grand piano with built-in electronic musical instrument. Such grand piano is disclosed in detail for example in Japanese Patent Application No. H5-214411 filed by the applicant of the present application and others.

For forming event data which composes the MIDI information with the control component 19, data with 3-bytes unit consisting of one status byte and two data bytes can be employed. In the status byte, for example key depression (note on) data and key elevation (note off) data are stored. In the data byte, for example key number (note number) data which represent the pitch and key stroke strength (velocity) data which represent the sound volume are stored.

INDUSTRIAL APPLICABILITY

As detailed above, according to the piano with built-in electronic musical instrument of the present claim 1, the modification data for modifying the stored effectiveness of the keys are set so that the sound generating condition when the electronic piano is operated equals to that when the acoustic piano is operated. Therefore, when a player operates the electronic instrument with the same touch as in playing the usual acoustic piano, the same sounds as those of the acoustic piano are obtained without feeling any sense of incompatibility. Accordingly, the piano playing improves by practicing and playing the electronic musical instrument.

According to the invention of the present claim 2, since the modification data are modified corresponding to a particular key or groups of keys, for example black keys and white keys, the amount of the modification data to be stored can be small.

What is claimed is:

1. A piano with built-in electronic musical instrument, which is an acoustic piano with built-in electronic musical instrument having an electronic sound source, and can be played by switching between an acoustic piano playing mode and an electronic musical instrument playing mode, comprising:

a keyboard which is used in common when the acoustic piano playing mode has been selected and when the electronic musical instrument playing mode has been selected;

an input condition detecting means for detecting the input information from a key of said keyboard when said electronic musical instrument playing mode has been selected;

a modification data storing means for storing modification data which are map data or arithmetic expression data for modifying the input information of said key; and an input information modification means for modifying the input information of said key detected by said input condition detecting means based on the modification data stored in said modification data storing means, wherein:

the modification data stored in said modification data storing means are set so that the sound generating condition in operation of said keyboard when said electronic musical instrument playing mode has been selected substantially coincides with that in operation of said keyboard with the same key touch when the acoustic piano playing mode has been selected.

2. The piano with built-in electronic musical instrument of claim 1, wherein said modification data are modified corresponding to a particular key or groups of keys.

3. The piano of claim 1, wherein the modification data stored in said modification data storing means is a function of:

the relationship between the key input condition and output sound characteristics when the piano is in the acoustic mode; and the actual relationship between the key input condition and the output sound characteristics when the piano is played in the electronic mode according to a desired linear relationship between the key input condition and the output sound characteristics.

4. A piano with built-in electronic musical instrument, which is an acoustic piano with built-in electronic musical instrument having an electronic sound source and a keyboard used for both modes, comprising:

an input condition detecting means for detecting the key stroke strength on said keyboard when played using said electronic musical instrument;

a modification data storing means for storing modification data which are map data or arithmetic expression data for determining the relationships between the key stroke strength and the sound volume of the electronic musical instrument; and an input information modification means for modifying the input information of said key detected by said input condition detecting means based on the modification data stored in said modification data storing means, wherein:

the modification data stored in said modification data storing means are set so that the sound volume produced when the piano is in the electronic mode is substantially the same as, for the same key stroke strength of the same key on said keyboard when the acoustic piano is operated.

5. A piano having an acoustic portion and a built-in electronic musical instrument portion having an electronic sound source and a keyboard used for both an acoustic piano playing mode and an electronic musical instrument playing mode, the piano comprising:

an input condition detecting means for detecting the key stroke strength of at least one key of the keyboard when the piano is played using the electronic musical instrument;

a conversion data storage means for storing conversion data which are map data or arithmetic expression data for determining the relationships between the key stroke strength and at least one output characteristic of the electronic musical instrument; and an input information conversion means for converting the key stroke strength based on the conversion data stored in the conversion data storage means in order to determine the at least one output characteristic, wherein the conversion data are set so that the at least one output characteristic produced by each key of the keyboard at a particular key stroke strength in the electronic mode is substantially similar to the at least one output characteristic produced by each same key at each same particular key stroke strength in the acoustic mode.

6. The piano of claim 5, wherein the conversion data stored in the conversion data storage means is a function of:

the relationship between the key stroke strength and the at least one output characteristic when the piano is in the acoustic mode; and the actual relationship between the key stroke strength and the at least one output characteristic when the piano is played in the electronic mode according to a desired linear relationship between the key stroke strength and the at least one output characteristic.

* * * * *